United States Patent [19]

Bailey et al.

[11] Patent Number: 4,614,064

[45] Date of Patent: Sep. 30, 1986

[54] METHOD AND APPARATUS FOR CLEANING WORKPIECES

[75] Inventors: Horace A. Bailey, Smithburg; Jack B. Grier, Hagerstown, both of Md.

[73] Assignee: Kennecott Corporation, Cleveland, Ohio

[21] Appl. No.: 697,564

[22] Filed: Feb. 1, 1985

Related U.S. Application Data

[63] Continuation of Ser. No. 392,306, Jun. 25, 1982, abandoned.

[51] Int. Cl.[4] ..... B24C 3/10

[52] U.S. Cl. ..... 51/420; 51/416; 51/319

[58] Field of Search ..... 51/417, 418–420, 51/431, 416, 215 E, 43; 198/740, 746, 487, 492, 403

[56] References Cited

U.S. PATENT DOCUMENTS

| | | |
|---|---|---|
| 2,778,164 | 10/1955 | Lasater et al. . |
| 2,917,991 | 12/1959 | Segur . |
| 2,968,390 | 1/1961 | Anderson . |
| 3,071,258 | 1/1963 | Seigh et al. . |
| 3,435,943 | 4/1969 | Johnson . |
| 3,626,641 | 12/1971 | Powell et al. . |
| 3,748,787 | 7/1973 | Carpenter et al. . |
| 3,813,817 | 6/1974 | Haberlin . |
| 3,903,642 | 9/1975 | Baughman et al. . |
| 4,001,976 | 1/1977 | MacMillan . |
| 4,161,086 | 7/1979 | Toedtli . |
| 4,326,362 | 4/1982 | Williams et al. . |

FOREIGN PATENT DOCUMENTS

| | | |
|---|---|---|
| 2446702 | 5/1975 | Fed. Rep. of Germany . |
| 245273 | 1/1926 | United Kingdom . |

OTHER PUBLICATIONS

IBM Technical Disclosure Bulletin, vol. 17, No. 4, 9/74, "Inverter for Flat Parts Being Indexed on a Belt", T. J. Cochran, A. S. Gasparri, W. G. Rance.

*Primary Examiner*—Frederick R. Schmidt
*Assistant Examiner*—Robert A. Rose
*Attorney, Agent, or Firm*—Porter & Troll Co.

[57] ABSTRACT

A method and apparatus for cleaning a succession of workpieces such as automobile engine blocks includes a first cleaning mechanism wherein cleaning media such as steel shot is directed against the workpieces. After being discharged from the first cleaning mechanism, the workpieces are inverted and passed through a second cleaning mechanism where cleaning media again is directed against the workpieces. In the second cleaning mechanism, the workpieces are separated so that the ends of the workpieces can be cleaned. The invention includes turning mechanisms for inverting the workpieces one-by-one, as well as devices for controlling the movement of the workpieces through the different cleaning and turning mechanisms.

15 Claims, 15 Drawing Figures

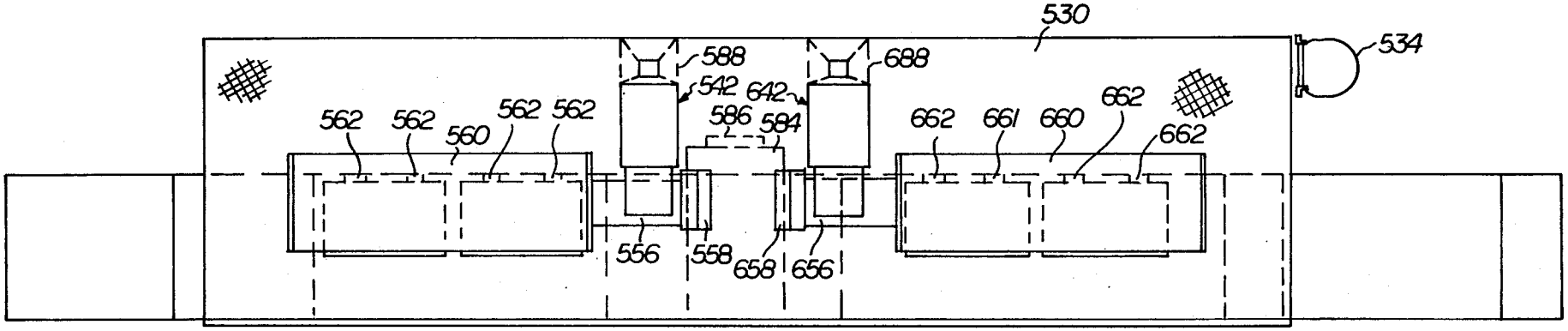
FIG. 1
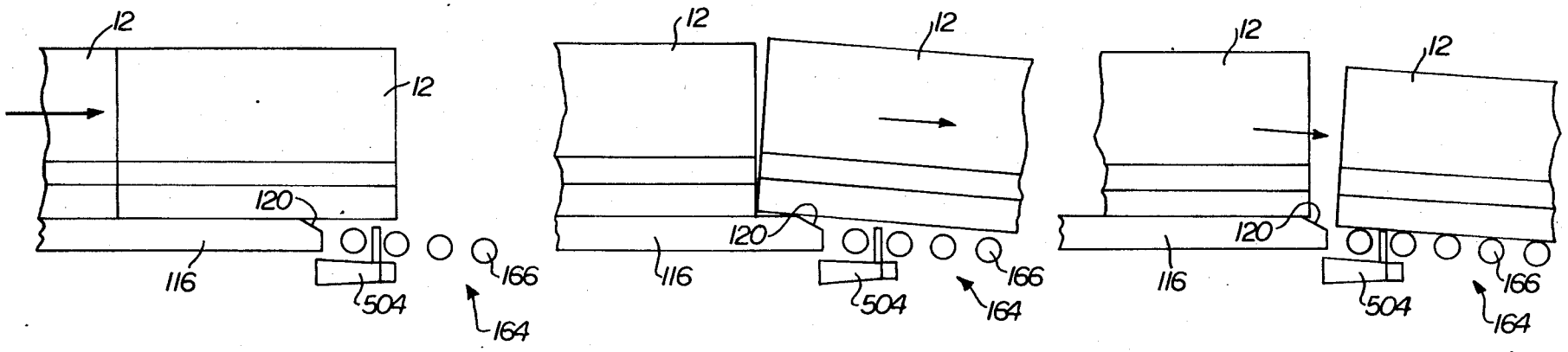
FIG. 13
FIG. 12
FIG. 11

METHOD AND APPARATUS FOR CLEANING WORKPIECES

CROSS REFERENCE TO RELATED APPLICATION

This is a continuation of application Ser. No. 392,306, filed June 25, 1982 now abandoned.

BACKGROUND OF THE INVENTION

1. Field of the Invention

The invention relates to a method and apparatus for cleaning workpieces and, more particularly, to a technique for cleaning workpieces such as automobile engine blocks wherein workpieces are passed through chambers where cleaning media is directed against the workpieces.

2. Description of the Prior Art

Parts such as automobile engine blocks commonly are formed by casting molten metal in a mold comprised of sand and binding agents. After the metal has cooled and the sand mold has been removed from about the parts, a thin layer of sand and other residue remains on the surface of the parts. It is necessary to clean the surface of the parts before the parts can be processed further. An especially effective technique for cleaning the surface of cast parts has been by blast cleaning.

In the blast cleaning process, workpieces are passed through a chamber where cleaning media such as steel shot is thrown against the outer surface of the parts. So-called blast wheels have been used to throw quantities of shot. Typically, blast wheels include a plurality of radially extending paddles. Upon introducing shot particles near the base of the paddles, the shot will be flung outwardly at a high rate of speed by the paddles. By directing the stream of cleaning media in appropriate directions, all surfaces of a workpiece can be blasted free of sand or other surface particles. An especially effective technique for blast cleaning continuously fed parts such as automobile engine blocks and the like is disclosed in U.S. Pat. No. 3,903,652, "Continuous Cleaning Apparatus," issued to Davis L. Baughman and James H. Carpenter, Jr. on Sept. 9, 1975, the disclosure of which is incorporated herein by reference. Other related developments are disclosed in U.S. Pat. No. 3,626,641, "Continuous Cleaning Apparatus," issued to George W. Powell et al on Dec. 14, 1971 and U.S. Pat. No. 3,748,787, "Workpiece Treating Apparatus," issued to James H. Carpenter et al on July 31, 1973, the disclosures of which are incorporated herein by reference.

The referenced patents disclose a technique for cleaning cast parts such as automobile engine blocks by impinging cleaning media upon the parts. The parts are pushed end to end in a line through a rotating barrel open at both ends. The barrel relatively closely conforms to the contour of the parts to be cleaned. Blast wheels located about the circumference of the barrel enable exposed surfaces of the workpieces to be cleaned in relatively short periods of time and with the use of a relatively small number of blast wheels. In effect, a blast stream is impacting the workpieces at all times. Because the barrel is rotated continually, internal passages in the workpieces are drained of cleaning media so that new impacts are not masked by retained media and also so that a new surface is presented to the media at all times. The device referred to is relatively easy to automate and delivers cleaned parts in a position for convenient automatic handling.

One disadvantage of the referenced device is that it is essentially a "one-part" machine, that is, the barrel must be designed to closely fit a particular size of workpiece being moved through the barrel. Also, because the workpieces are pushed against each other, it is difficult or impossible to clean the ends of the workpieces. Although several concepts have been devised to clean the ends of the workpieces (see especially the '641 and '787 patents referred to above), all existing devices are rather complex. In effect, a machine suitable for processing only one size of workpiece is provided.

Although the referenced devices are excellent for cleaning parts of one size at a high rate of speed, there is a need for a machine to clean parts of various sizes and which is easy to automatically load and unload. Desirably, an improved device would be able to utilize existing blast wheels and other equipment as much as possible in order to maximize cleaning efficiency and minimize expense of manufacture. A desirable machine would dispose blast wheels about the periphery of the workpieces in order to eliminate the complexity of rotation of prior devices and to eliminate the need for a close-fitting barrel. Preferably, an improved device would create a gap between parts in order to enable the ends of the parts to be cleaned and would enable cleaning media to be drained from internal passages in the parts.

SUMMARY OF THE INVENTION

The present invention provides a new and improved method and apparatus for cleaning workpieces wherein the foregoing difficulties are overcome, and the foregoing objectives are acheived. Apparatus according to the invention for cleaning a succession of workpieces includes a first cleaning mechanism for directing cleaning media against the workpieces, the workpieces being passed from one end of the cleaning mechanism to the other during a cleaning operation. A workpiece advancing mechanism is provided for controlling entrance of workpieces into the first cleaning mechanism and for controlling discharge of workpieces from the first cleaning mechanism. A workpiece turning mechanism is provided to turn workpieces upside-down after their discharge from the first cleaning mechanism, and a second cleaning mechanism is provided for directing cleaning media against the workpieces. After the workpieces pass through the second cleaning mechanism, a second workpiece turning mechanism is provided so as to orient the workpieces the same way they were upon entry to the apparatus for further automatic processing.

The first cleaning mechanism is in the form of a relatively large chamber. A plurality of blast wheels, as is known in the art, are disposed at various positions within the chamber in order to direct streams of cleaning media against workpieces passing through the chamber. The size of the chamber permits workpieces of a wide range of sizes to be accommodated. Skid rails are provided to guide the workpieces during their passage through the chamber, the skid rails being so configured and arranged that workpieces of a wide range of sizes can be accommodated without difficulty.

After their discharge from the first chamber, the workpieces are turned end for end, or inverted, by a turning mechanism in the form of a wheel having radially extending slots. In a preferred embodiment, four slots are provided, each being spaced 90° from adjacent slots. The slots include rollers disposed along each radially extending wall. By appropriate positioning of the turning mechanism relative to the first cleaning mechanism, workpieces can enter the slots sequentially. Upon rotation of the wheel, the workpieces first will be turned on end and then will be inverted for further cleaning. Accumulated cleaning media will be drained from internal passageways upon inversion of the workpieces.

After being inverted, the workpieces are passed through a second cleaning mechanism. During passage through the second cleaning mechanism, the workpieces are carried by rollers which, by being rotated at different speeds, enable the workpieces to be spaced for cleaning of the ends of the workpieces. After passage through the second cleaning mechanism, the workpieces are directed into a second turning mechanism substantially similar to the first turning mechanism where the workpieces can be inverted again to an orientation the same as that in which they entered the first cleaning mechanism.

A feature of the invention resides in the technique by which workpieces are moved through the apparatus and by which the apparatus is controlled. The advance mechanism for the workpieces includes a conveyor for advancing workpieces under the influence of gravity. A clamp engages the workpieces to control movement of the workpieces along the conveyor. A stop engages the workpieces and prevents their movement along the conveyor, the advance of workpieces to the stop being permitted by selective actuation of the clamp. A powered conveyor is provided for advancing workpieces from the first conveyor to the first cleaning mechanism. A pusher engages the workpieces to force them through the first cleaning mechanism, the workpieces being presented to the pusher sequentially upon selective actuation of the stop and the powered conveyor.

The pusher is in the form of a pivotally mounted arm carried by an axially movable carrier. The arm engages the faces of the workpieces furthest from the first cleaning mechanism on a forward stroke of the carrier. The arm is pivoted out of the way of the workpieces on a return stroke of the carrier in readiness for engaging another workpiece.

In order to properly control spacing of the workpieces for entry into the turning mechanism and for other purposes, it is necessary to automatically take into account different sizes of workpieces that may be advancing through the mechanism. This is accomplished by providing a control switch positioned at the discharge end of the first cleaning mechanism, the control switch serving to actuate the advance mechanism only when a workpiece has exited from the first cleaning mechanism. In a preferred embodiment, the control switch is in the form of a limit switch constructed and arranged relative to the first cleaning mechanism such that workpieces exiting the first cleaning mechanism pass over the limit switch during initial portions of discharge from the first cleaning mechanism and contact the limit switch only upon being completely discharged from the first cleaning mechanism.

Other features and advantages of the invention, and a fuller description thereof, may be had by referring to the following description and claims, taken in conjunction with the accompanying drawings.

DESCRIPTION OF THE DRAWINGS

FIG. 1 is a schematic top plan view of apparatus according to the invention for cleaning workpieces such as automobile engine blocks;

FIGS. 11–13 illustrate movement of a workpiece and a control switch used in actuating portions of the advance mechanism;

DESCRIPTION OF THE PREFERRED EMBODIMENT

Figure 2:
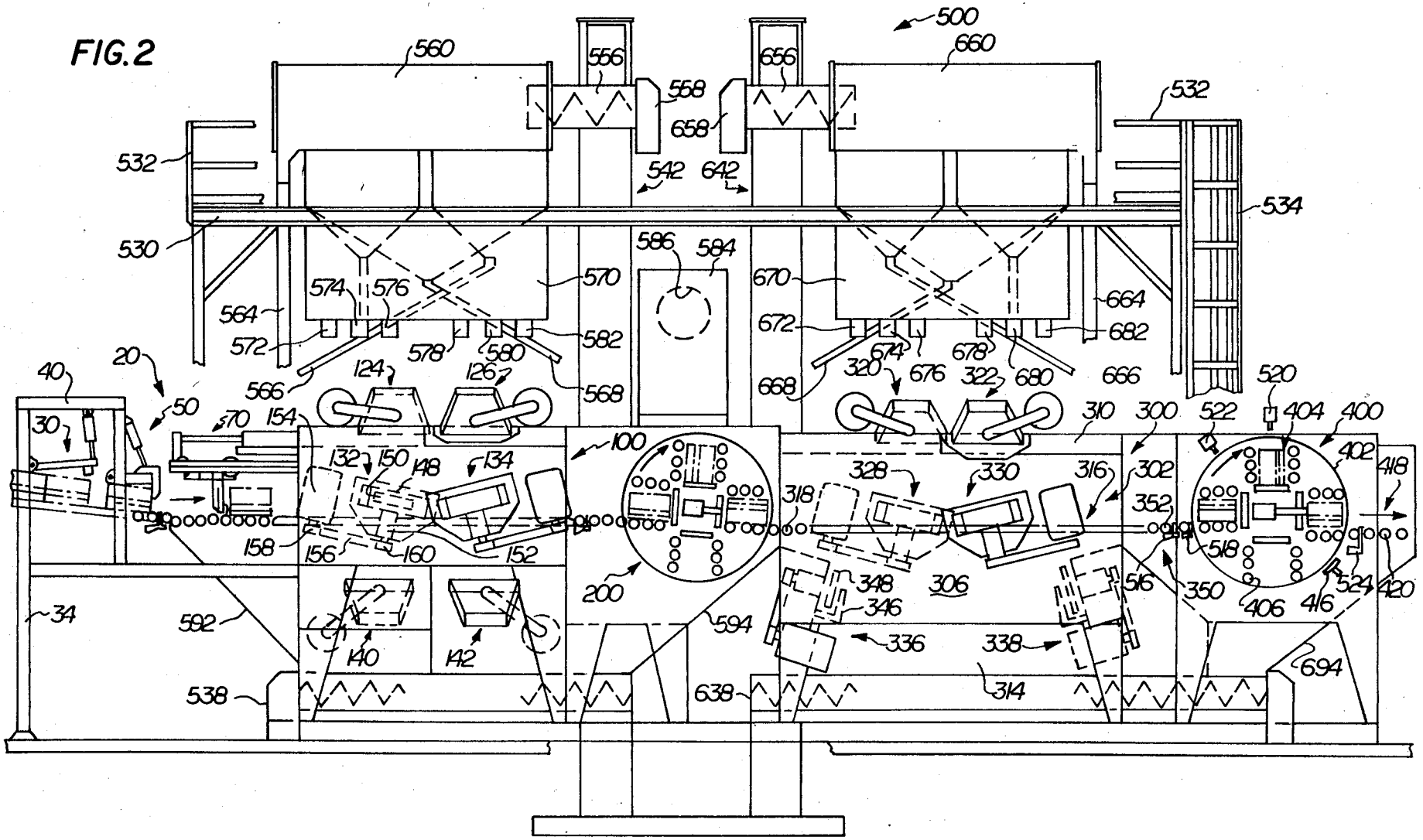
FIG. 2 is a side elevational view of the apparatus of FIG. 1.
Figure 3:
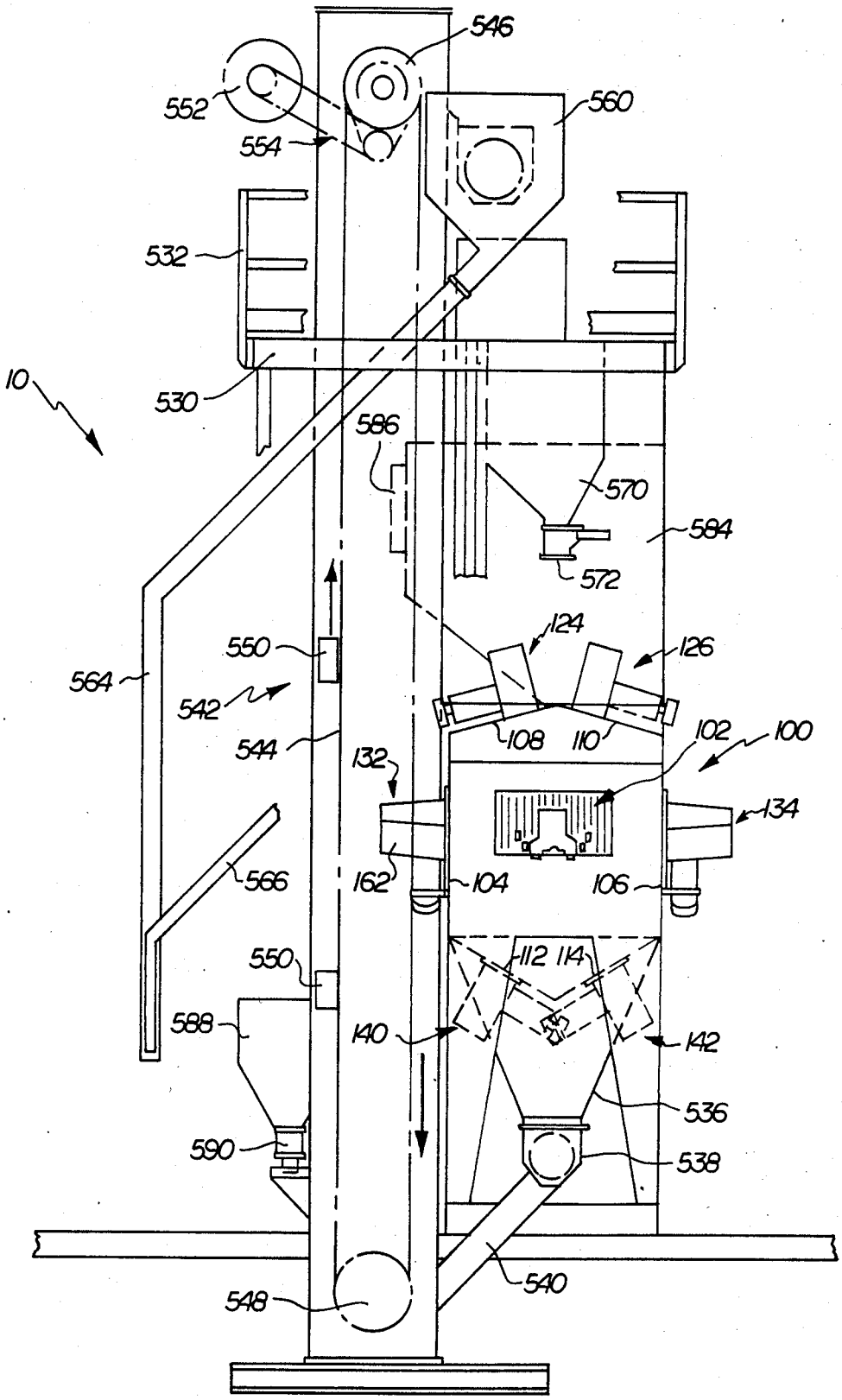
FIG. 3 is an end elevational view of the apparatus of FIG. 1.
Figure 4:
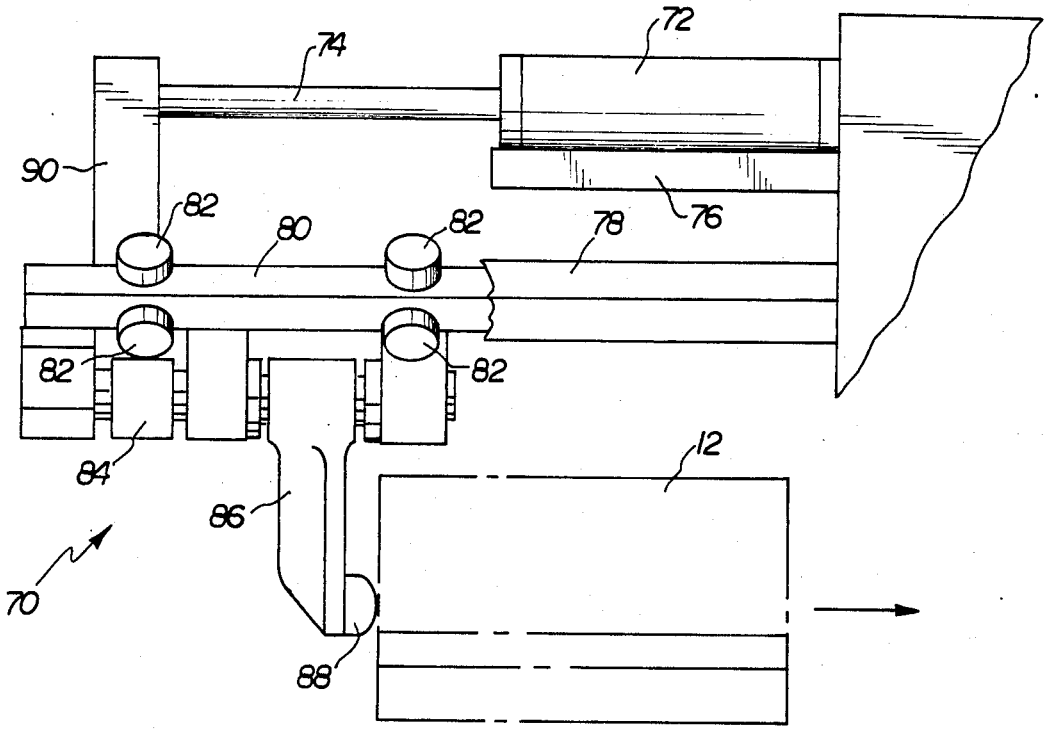
FIG. 4 is an enlarged side elevational view of a portion of a pusher mechanism according to the invention.
Figure 5:
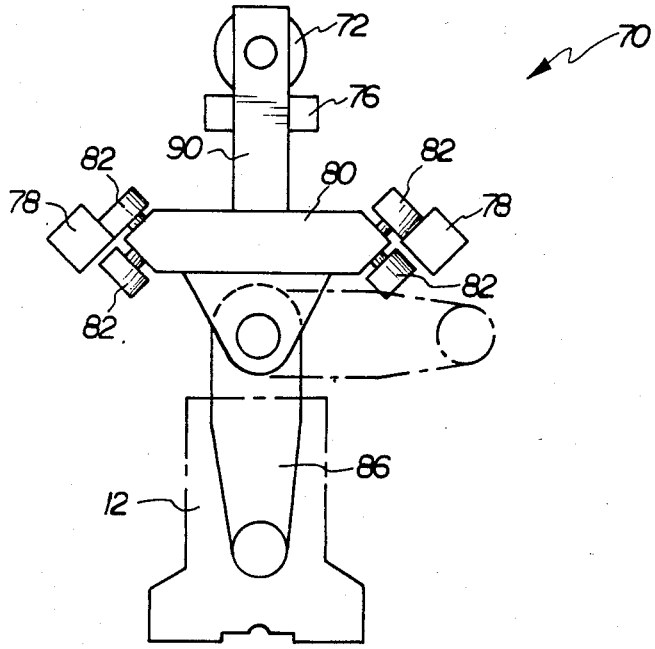
FIG. 5 is an end elevational view of the pusher mechanism of FIG. 4.
Figure 6:
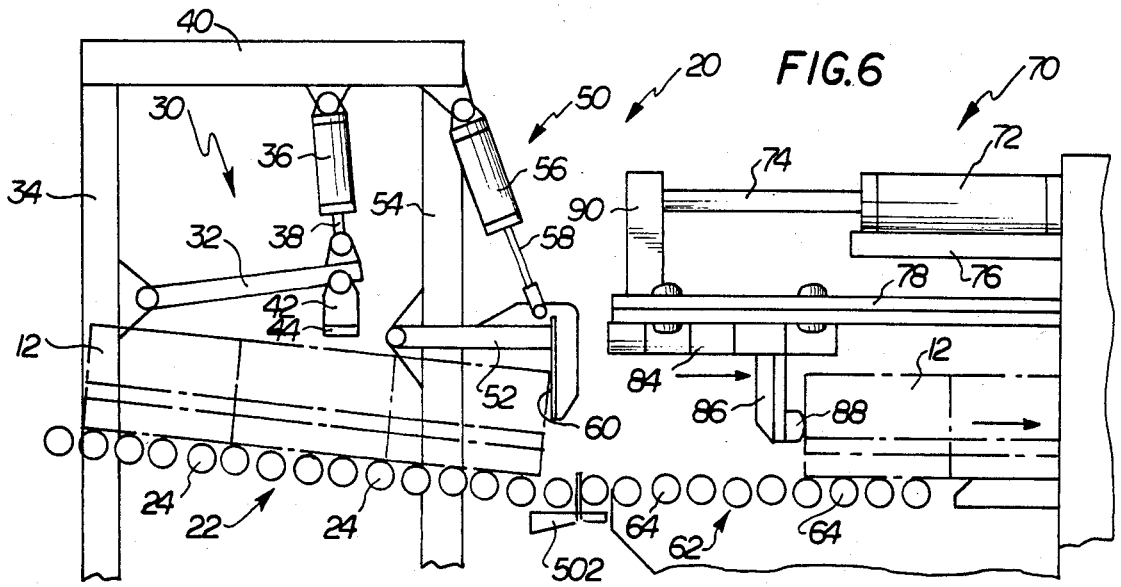
FIG. 6 is an enlarged view of portions of an advance mechanism according to the invention in which a clamp, a stop, and a pusher mechanism are employed to control movement of workpieces.
Figure 7:
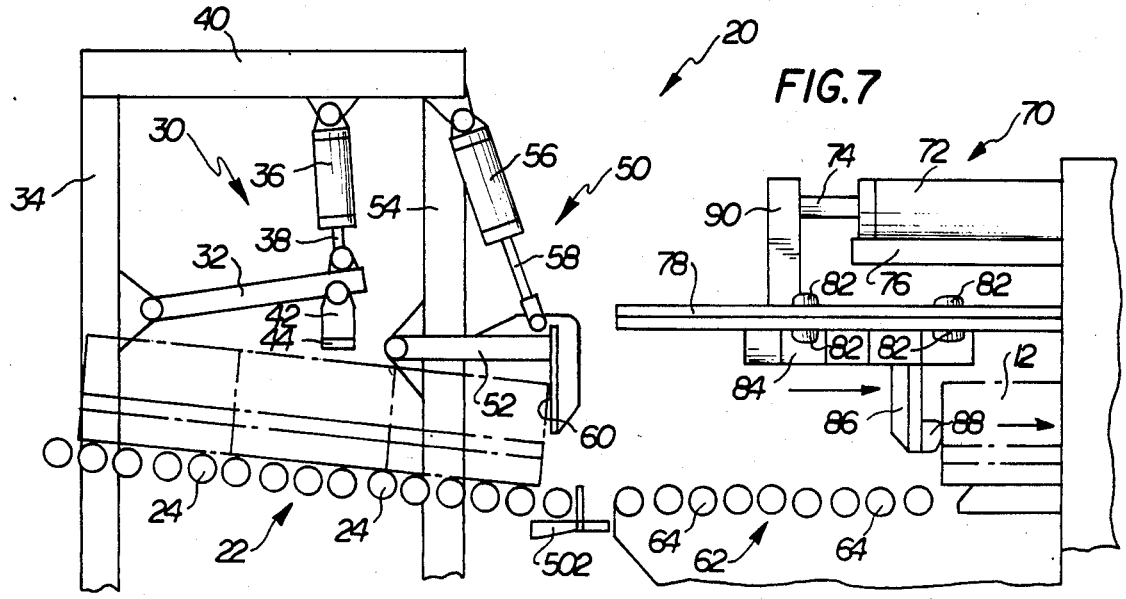
FIGS. 7 and 8 are views similar to FIG. 6, showing the advance mechanism in different operative positions.

Referring particularly to FIGS. 1–3, apparatus 10 for cleaning a succession of workpieces 12 such as automobile engine blocks is shown. The apparatus 10 includes an advance mechanism 20 for controlling admission of workpieces 12 into the apparatus 10, a first cleaning mechanism 100, a first turning mechanism 200 for inverting workpieces 12 after their passage through the first cleaning mechanism 100, a second cleaning mechanism 300, a second turning mechanism 400, and various control and auxiliary equipment 500. The components of the apparatus 10 will be described individually.

I. The Advance Mechanism 20

Figure 10:
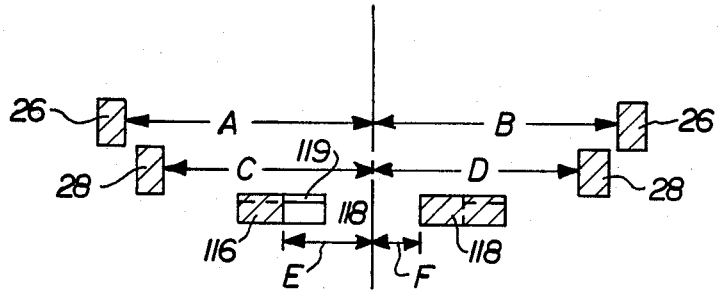
FIG. 10 is a cross-sectional view taken along a plane indicated by line 10—10 in FIG. 9.

The advance mechanism 20 includes a conveyor section 22 upon which workpieces 12 can move to the right as viewed in the FIGURES under the influence of gravity. The conveyor 22 is inclined downwardly two or three degrees to the horizontal. The conveyor 22 includes a plurality of rollers 24 each having a covering of polyurethane or an equivalent rubber material to provide maximum traction and control of workpieces 12. Fixed side guides 26, 28 (shown in FIGS. 3 and 10) are installed on both sides of the advance mechanism 20 in order to properly guide the passage of workpieces 12 during their advance to and through the first cleaning mechanism 100.

Workpieces 12 approaching the first cleaning mechanism 100 advance sequentially in end-to-end contact where they are restrained by a clamp 30. The clamp 30 includes a generally horizontally extending arm 32 pivotally connected to a vertically extending support member 34 at one end. The other end of the arm 32 is connected to a hydraulically actuated cylinder 36 by an extensible piston rod 38. The piston rod 38 is connected to the arm 32 near the end of the arm 32. The cylinder 36 and rod 38 are oriented generally vertically and are connected to horizontally extending support member 40. A shoe 42 having a covering of polyurethane or equivalent rubber material 44 on its underside is secured to the arm 32 near the end of the arm 32. By appropriate actuation of the cylinder 36, the shoe 42 can be brought into contact with the upper surface of workpieces 12 so as to control the movement of the workpieces 12 along the conveyor 22.

A stop 50 is provided to enable workpieces 12 to be released one at a time while approaching workpieces 12 are held by the clamp 30. The stop 50 includes a generally horizontally extending arm 52 pivotally mounted at one end to a vertically extending supporting member 54. A hydraulically actuated cylinder 56 is oriented generally vertically and is connected at one end to the support member 40. A piston rod 58 extends outwardly from the cylinder 56 and is connected to the end of the arm 52. A downwardly extending plate 60 engages the forward end of the workpiece 12.

The advance mechanism 20 also includes a conveyor 62 having a plurality of rollers 64 covered with polyurethane or an equivalent rubber material to provide maximum traction and control for the workpieces 12. The conveyor 62, in contrast to the conveyor 22, entends generally horizontally and is powered to provide a positive drive for the workpieces 12 when desired. A flexible curtain 66 extends downwardly at the upstream end of the conveyor 64 to assist in preventing cleaning media from being discharged from the apparatus 10.

A pusher 70 is provided to move workpieces 12, one at a time, into the cleaning mechanism 100. Referring particularly to FIGS. 4–8, the pusher 70 includes a hydraulically actuated cylinder 72 from which a piston rod 74 extends. The piston rod 74 moves in a generally horizontal plane. The cylinder 72 is secured to a horizontally extending support member 76. A pair of tubing rails 78, square in cross-section, extend forwardly of the support member 76. The tubes 78 are oriented such that the flat surfaces of the tubes 78 are positioned at a 45° angle relative to the horizontal and vertical, as the case may be. A carrier 80 is disposed intermediate the tubes 78 and is connected thereto for movement therealong by cam rolls 82. The carrier 80 includes, on its underside, a hydraulically actuated cylinder 84. The cylinder 84 includes a pivotally mounted arm 86 having at its end a bumper pad 88. Upon actuation of the cylinder 84, the arm 86 is pivoted through an arc of 90° from a vertical position to a horizontal position, or vice versa. A vertically extending member 90 connects the end of the piston rod 74 and the carrier 80.

As will be apparent from an examination of FIGS. 4–8, upon actuation of the cylinder 72, the rod 74 will be extended or retracted and, consequently, the carrier 80 will be moved back and forth relative to the apparatus 10. Maximum stroke of the carrier 80 is approximately 1400 mm. On a forward stroke of the carrier 80, the cylinder 84 is actuated to orient the arm 86 vertically so as to cause the pad 88 to engage the back face of workpieces 12. On a return stroke of the carrier 80, the cylinder 84 is actuated to pivot the arm 86 to a horizontal position, whereby the arm 86 will clear the upper surface of the workpieces 12.

II. The First Cleaning Mechanism 100

Figure 9:
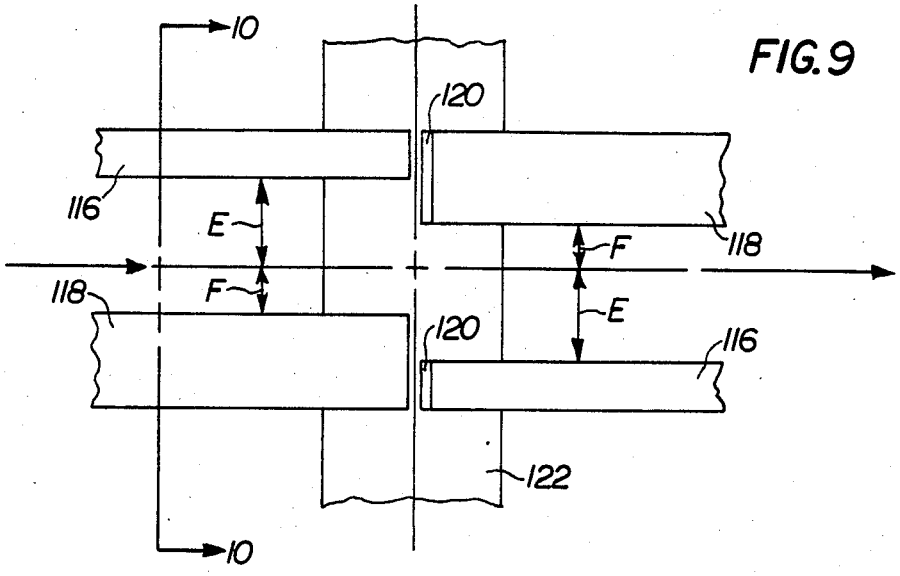
FIG. 9 is a plan view of a portion of a skid rail system employed to support workpieces during a portion of their travel.

The first cleaning mechanism 100 includes a chamber 102 (FIG. 3) through which workpieces 12 pass in order to be cleaned. The chamber 102 is defined by opposed sidewalls 104, 106, inclined roof sections 108, 110, and inclined floor sections 112, 114. The chamber 102 is open at each end except for appropriate curtains. A pair of spaced, horizontally extending skid rails 116, 118 extend through the center of the chamber 102 and enable workpieces 12 resting thereon to be moved from one end of the chamber 102 to the other. The ends of the rails 116, 118 are chamfered as at 120. The rail 116 is narrower than the rail 118. In order to ensure that the maximum surface area of the workpiece 12 is exposed to cleaning media, the rails 116, 118 are placed on opposite sides of the chamber 102 halfway through the cleaning mechanism 100 (see FIGS. 9 and 10). The ends of the rails 116, 118 are supported at the center of the chamber 102 by a center support 122. The side guides 26, 28 extend through the chamber 102 in proximity with the skid rails 116, 118.

In the preferred embodiment of the invention, the rails 116, 118 are formed of a hardened steel in order to resist wear. The guides 26, 28 are formed of manganese steel. The rail 116 is 25 mm×40 mm in cross-section, while 30 the rail 118 is 25 mm×75 mm in cross-section. The guides 26, 28 are 20 mm×40 mm in cross-section. Preferred spacings of the guides and the rails 116, 118 can be found by referring to FIGS. 9 and 10 and the following table:

| Reference Letter | Dimension (mm) |
|---|---|
| A | 210 |
| B | 210 |
| C | 180 |
| D | 180 |
| E | 80 |
| F | 45 |

The first cleaning mechanism 100 includes a plurality of upper blast wheel assemblies 124, 126, 128, 130 for directing cleaning media into the chamber 102 through openings in the roof sections 108, 110. The blast wheel assembly 130 is not illustrated in the FIGURES. A plurality of middle blast wheel assemblies 132, 134, 136, 138 extend through openings in the sidewalls 104, 106 in order for cleaning media to be directed into the chamber 102. The blast wheel assembly 138 is not visible in the FIGURES.

A plurality of lower blast wheel assemblies 140, 142, 144, 146 extend through openings in the floor sections 112, 114 so as to enable cleaning media to be directed into the chamber 102 from lower portions of the chamber 102. The blast wheel assembly 146 is not visible in the FIGURES.

As will be apparent from an examination of FIGS. 2 and 3, the various blast wheel assemblies 124–146 are arranged relative to the skid rails 116, 118 such that workpieces 12 moving along the skid rails 116, 118 will be impacted from all sides with streams of cleaning media. Each blast wheel assembly 124–146 is substantially identical, except for variations in placement relative to the chamber 102. Accordingly, only details of the blast wheel assembly 132 will be described for purposes of convenience, it being assumed that the other blast wheel assemblies are constructed similarly.

The blast wheel assembly 132 includes a wheel 148 from which a plurality of paddles 150 extend radially. Only a portion of the paddles 150 can be seen in the FIGURES. A bearing assembly 152 supports the wheel 148 for rotation. A motor 154 is connected to the bearing assembly 152 by V-belts 156 reeved about pulleys 158, 160. A housing 162 surrounds the wheel 148. Upon activation of the motor 154, the wheel 148 will be caused to rotate at a speed directly proportional to the speed of rotation of the motor 154. Cleaning media such as steel shot introduced to the center of the wheel 148 will be flung outwardly by the paddles 150. By appropriate design of the wheel 148 and the paddles 150, and by appropriate configuration and orientation of the housing 162, a stream of high-velocity cleaning media can be directed as desired. In the environment of the present invention, the 12 blast wheel assemblies 124–146 can be used to effectively clean the exposed surfaces of workpieces 12 passing through the cleaning mechanism 100. Additional details of the blast wheels 124–146 are well-known, such assemblies being commercially available from the Pangborn Company of Hagerstown, Md.

After passage through the chamber 102, workpieces 12 are discharged from the first cleaning mechanism 100 in a manner illustrated in FIGS. 11–13. A powered conveyor 164 receives workpieces 12 discharged from the skid rails 116, 118. The rollers 166 of the conveyor 164 are provided with a covering of polyurethane or equivalent rubber material and a hydraulic drive (not shown). A control switch 504 (described subsequently) is positioned between the conveyor rollers 166 immediately adjacent the end of the skid rails 116, 118. The conveyor 164 is positioned at a vertical level slightly below that of the uppermost surface of the skid rails 116, 118. As a workpiece 12 is discharged from the chamber 102, the leading edge of the workpiece 12 tips downwardly over the chamfered edged 120 and engages one of the rollers 166 on the downstream side of the switch 504. The workpiece 12 does not contact the switch 504 until the workpiece 12 is completely disengaged from the rails 116, 118.

III. The First Turning Mechanism 200

Figure 14:
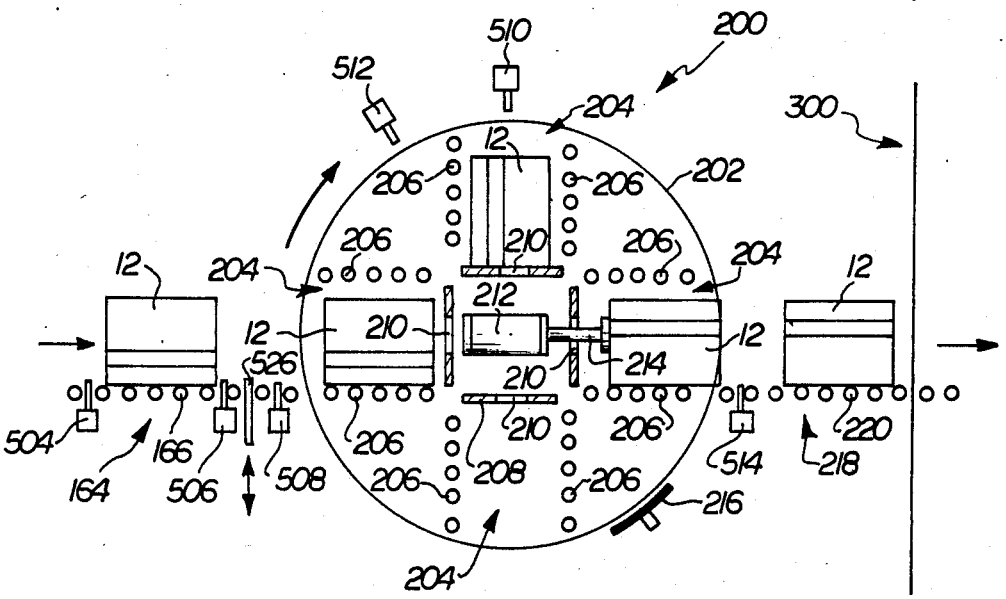
FIG. 14 is an enlarged side elevational view of a turning mechanism according to the invention.

Referring particularly to FIGS. 2 and 14, the first turning mechanism 200 includes a wheel 202 supported for rotation in a vertical plane lying in the path of travel of the workpieces 12. The drive for the wheel 202 is not shown. The wheel 202 includes four slots 204 extending radially outwardly. The slots 204 are spaced 90° from adjacent slots. Each slot 204 includes along its walls a plurality of rollers 206. The base of each slot 204 is closed by a plate 208 having a central aperture 210. A hydraulic cylinder 212 is disposed at the center of the wheel 202 and includes a ram 214 lying in a horizontal plane. The ram 214 is positioned so as to move along the path of travel of the workpieces 12 on a forward stroke of the ram 214. Upon activation of the cylinder 212, the ram can be extended through the openings 210 to cause workpieces 12 to be ejected from the slots 204 when desired.

A brake 216 is positioned at the periphery of the wheel 202. Upon activation of the brake 216, rotation of the wheel 202 will be prevented. The first turning mechanism 200 also includes a short conveyor section 218 having a plurality of so-called friction rollers 220 disposed immediately downstream of the wheel 202. The friction rollers 220 are covered with polyurethane or an equivalent rubber material. The rollers 220 are driven by a hydraulic drive (not shown).

As will be apparent from an examination of FIGS. 2 and 14, upon rotation of the wheel 202 and insertion of workpieces 12 into the slots 204, the workpieces 12 will be inverted. Rotation of the wheel 204 as viewed in FIGS. 2 and 14 is clockwise. By inverting the workpieces 12 after their passage through the first cleaning mechanism 100, cleaning media collected in passages in the workpieces 12 will be dumped and additional portions of the workpieces 12 will be exposed for further cleaning.

IV. The Second Cleaning Mechanism 300

The second cleaning mechanism 300 is quite similar in construction and operation to the first cleaning mechanism 100, except that workpieces 12 passing through the second cleaning mechanism 300 are spaced so as to enable the ends of the workpieces 12 to be cleaned. The second cleaning mechanism 300 includes a chamber 302 defined by sidewalls 304, 306, roof sections 308, 310, and floor sections 312, 314 (wall 304 and sections 308, 312 are not visible in the FIGURES). The second cleaning mechanism 300 includes a powered conveyor 316 for moving workpieces 12 through the chamber 302. The conveyor 316 includes a plurality of manganese steel rollers 318 having circumferentially extending grooves. The rollers 318 are controllable by a hydraulic drive (not shown) so as to enable workpieces 12 to be spaced within the chamber 302. Spacing of the workpieces 12 enables the ends of the workpieces 12 to be cleaned.

In a manner similar to the first cleaning mechanism 100, the second cleaning mechanism 300 includes a plurality of blast wheel assemblies 320–342. Blast wheel assemblies 320–326 are located in the roof sections 308, 310, the middle blast wheel assemblies are located in the sidewalls 304, 306, and the lower blast wheel assemblies 336–342 are located in the floor sections 312, 314. The lower blast wheel assemblies 336–342 differ somewhat from the lower blast wheel assemblies 140–146 in that they include a so-called open wheel 344. The lower blast wheel assemblies 336–342 include a modified housing 346 which does not confine or direct the stream of cleaning media being discharged from paddles 348. Such a housing construction has been found to be more effective in cleaning automobile engine blocks that have been inverted for their passage through the second cleaning mechanism 300. It will be appreciated that the size and composition of the cleaning media used in a given cleaning operation, the size and speed of rotation of the wheels, the configuration and positioning of the wheel housings, and other, similar variables may be adjusted to suit the needs of a particular user. These variables are well-known to those skilled in the art and do not need further discussion here.

After the workpieces 12 have passed through the chamber 302, they are conveyed from the chamber 302 by a conveyor 350. The conveyor 350 includes a plurality of rollers 352 having a covering of polyurethane or equivalent rubber material. The conveyor 350 presents the workpieces 12 to the second turning mechanism 400.

V. The Second Turning Mechanism 400

The second turning mechanism 400 receives workpieces 12 from the conveyor 350 and inverts the workpieces 12 for discharge from the apparatus 10 in the same orientation as the workpieces 12 were received by the apparatus 10. The second turning mechanism 400 is virtually identical to the first turning mechanism 200. The second turning mechanism 400 includes a wheel 402 and a plurality of radially extending slots 404 having rollers 406 along their walls. Each of the slots 404 includes a bottom wall closed by a plate 408 having an aperture 410. A hydraulic cylinder 412 having a ram 414, like the cylinder 212, is positioned at the center of the wheel 402 to eject workpieces 12 from the slots 404. A brake 416 engages the periphery of the wheel 402 in order to selectively permit or prevent rotation of the wheel 402.

In a manner similar to that of the first turning mechanism 200, upon rotation of the wheel 404, in a clockwise direction as viewed in FIG. 2, workpieces 12 will be inverted for discharge from the apparatus 10. The workpieces 12 are carried away by a powered conveyor 418 having a plurality of rollers 420. Like the rollers of the other conveyors (except conveyor 316), the rollers of the conveyor 418 are covered with polyurethane or an equivalent rubber material.

VI. The Control and Auxiliary Equipment 500

The control and auxilary equipment 500 is employed to control operation of the apparatus 10 and to collect spent cleaning media and recycle the cleaning media. The control and auxiliary equipment 500 includes a control switch, or limit switch 502. The switch 502 is located near the intersection of the conveyor 22 and conveyor 64, adjacent the stop 50. The switch 502 projects upwardly through the rollers 64 of the conveyor 62 and is depressed whenever a workpiece 12 traverses the conveyor, and is raised whenever a workpiece 12 has completed its passage across the conveyor in which the switch 502 is located.

Other limit switches are provided that operate in a similar manner. The location of the limit switch 504 has been described already. Referring to FIGS. 2 and 14, limit switches 506 and 508 are positioned immediately upstream of the first turning mechanism 200. Limit switches 510, 512 are positioned about the periphery of the second turning mechanism. Limit switch 514 is positioned immediately downstream of the first turning mechanism 200. Limit switches 516, 518 are positioned immediately upstream of the second turning mechanism 400, limit switches 520, 522 are positioned about the periphery of the second turning mechanism 400, and limit switch 524 is positioned downstream of the second turning mechanism 400.

In addition to the limit switches, the control and auxilary equipment 500 includes stop 50 and a stop plate 526 positioned intermediate the limit switches 506, 508. The stop plate 526 can be raised or lowered as may be necessary in order to prevent the advance of workpieces 12. Similarly, another vertically adjustable stop plate 528 is provided intermediate limit switches 516, 518. The brakes 216, 416 also are part of the control and auxiliary equipment.

The functions of the various limit switches are as follows:

| Limit Switch | Function |
|---|---|
| 502 | Tripped by trailing end of workpiece 12, starts arm 86 downwardly, then carriage 80 forwardly |
| 504 | Tripped by trailing end of workpiece 12, stops carriage 80, then arm 86 upwardly and carriage 80 return |
| 506 | Safety-tripped by leading end of workpiece, stops conveyor 164 if cycle of first turning mechanism 100 is not completed. |
| 508 | Tripped by trailing end of workpiece 12-starts cycle of first turning mechanism 100, and raises stop plate 526 |
| 510 | Senses completion of cycle for first turning mechanism 100 |
| 512 | Causes stop plate 526 to drop |
| 514 | Safety - tripped by trail-end of workpiece 12 - holds turning mechanism 100 until released by workpiece 12 |
| 516 | Safety - tripped by leading edge of workpiece 12, stops conveyor 350 if cycle of second turning mechanism 200 is not completed |
| 518 | Tripped by trailing end of workpiece 12 - starts cycle for second turning mechanism 400 and raises stop plate 528 |
| 520 | Senses completion of cycle for second turning mechanism 400 |
| 522 | Causes stop plate 528 to be dropped |
| 524 | Safety - tripped by trail-end of workpiece 12 - holds second turning mechanism 400 until released by workpiece 12 |

Referring particularly to FIGS. 1–3, control and auxiliary equipment 500 also includes components for cleaning spent cleaning media and recycling the cleaning media. The apparatus includes a framework 530 superimposed above the mechanism described already. The framework 530 includes a safety railing 532 and an access ladder 534. A trough 536 is disposed beneath the chamber 102 to funnel spent cleaning media downwardly. A spiral conveyor 538 is positioned beneath the trough 535 and conveys spent media to a chute 540. The chute 540 directs the cleaning media to an elevator 542. The elevator 542 includes a vertically oriented belt 544 reaved about upper and lower pulleys 546, 548. The belt 544 carries a plurality of buckets 550 which gather discrete quantities of cleaning media. Power for the belt 544 is provided by a motor 552 and a belt drive systems 554.

Media collected by the buckets 550 is discharged into a spiral conveyor 556 driven by a motor 558. Media conveyed by the conveyor 556 is directed into a rotating cylindrical screen 560 where cleaning of the media occurs. A plurality of vent openings 562 permit dust and very fine particles to be withdrawn from the screen 560. Excessively large particles are discharged through a duct 564, excessively small particles are discharged through a duct 566, while overflow particles are conveyed by a duct 568 back to the elevator 542. Properly sized particles are collected in a hopper 570 and are held for discharge by gates 572, 574, 576, 578, 580, 582. The gate 572 controls the flow of media to the blast wheel assembly 124, the gate 574 controls the flow of media to the blast wheel assembly 126. The gates 576–582 similarly are associated with the blast wheel assemblies 132, 134, 140, 142. Other gates (not shown) are employed to convey cleaned media to the other blast wheel assemblies of the first cleaning mechanism 100.

A vent hood 584 is provided to remove dust and fine particles from the vicinity of the first turning mechanism 200. The vent hood 584 includes an opening 586 through which dust and small particles can be withdrawn from the vent hood 584. A refill hopper 588 is disposed near a lower portion of the elevator 542. When it is necessary to replenish cleaning media in the apparatus 10, new media can be added to the elevator 542 by actuation of a gate valve 590 disposed at the lower portion of the hopper 588. Guide members 592, 594 are disposed beneath the advance mechanism 20 and the first turning mechanism 200, respectively, in order to channel spent media and other particles into the spiral conveyor 538.

A system for retrieving and cleaning media also is provided for the second cleaning mechanism 300 and the second turning mechanism 400. The components are substantially identical with those already described, and these additional components are shown in the drawing FIGURES with reference numerals having the number "6" as a first digit. For example, a second elevator 642 is identical in construction and operation to the elevator 542. The hopper 670 is identical in construction and operation to the hopper 570. Other 600-series components are identical in construction and operation to like components bearing a 500-series reference numeral.

VII. Operation

Figure 15:
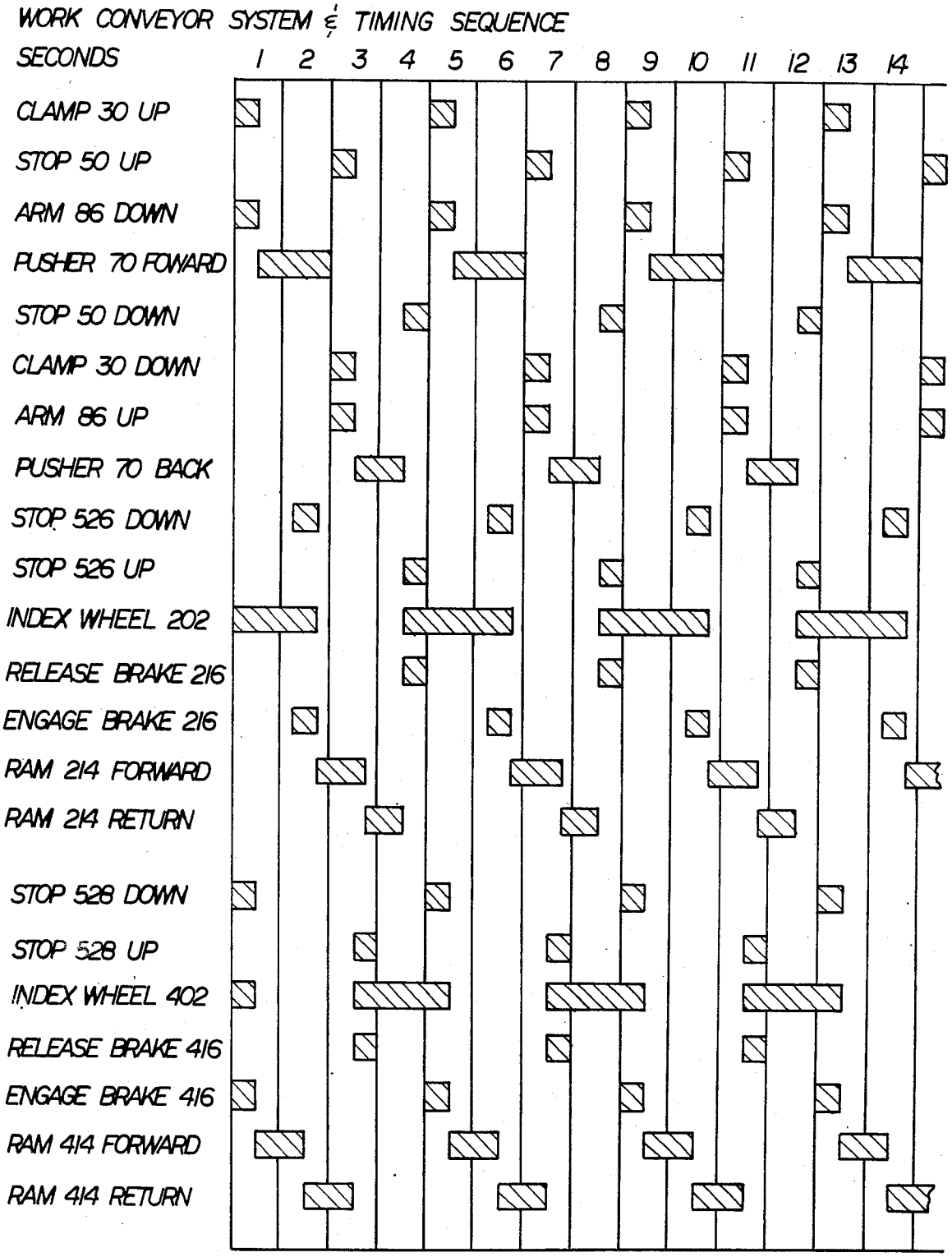
FIG. 15 is a diagrammatic representation of a timing sequence for various control elements included as part of the invention.

When it is desired to operate the apparatus 10, a plurality of workpieces 12 are positioned on the conveyor 22 where they are retained by the stop 50. It will be assumed for purposes of this discussion that cleaning media of appropriate size and quantity is provided to the various blast wheel assemblies at all times, and that the blast wheel assemblies are operated at appropriate speeds. Referring particularly to FIG. 15, the apparatus 10 can be operated to clean workpieces 12 such as automobile engine blocks every four seconds. A production rate of approximately 900 workpieces per hour is possible if the apparatus 10 is operated in accordance with the timing sequence set forth in FIG. 15.

Figure 8:
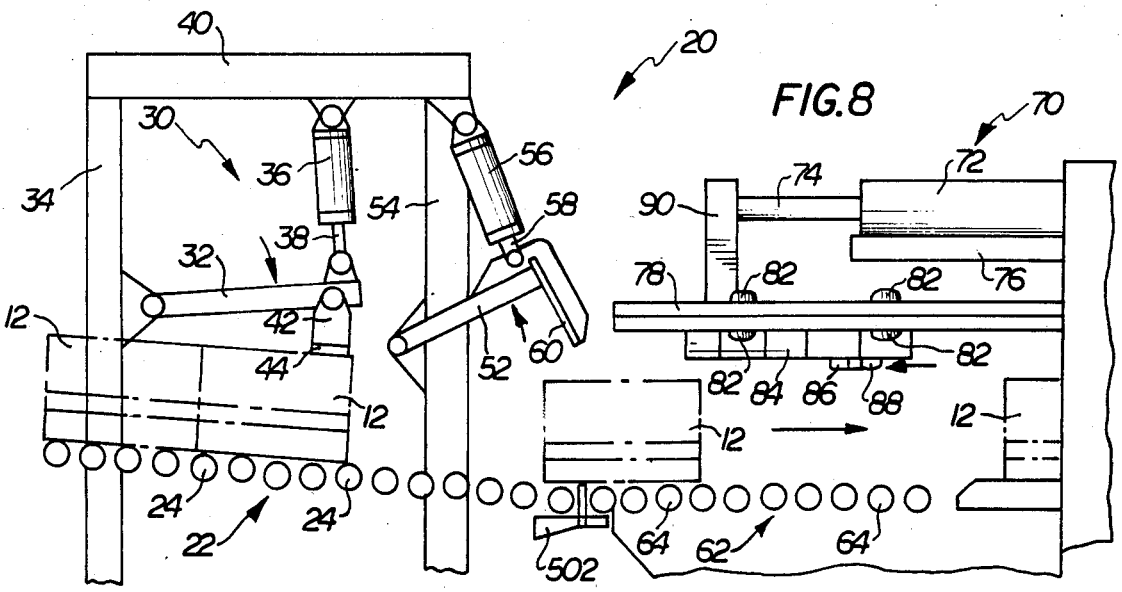

Referring also to FIGS. 6–8 and 14, when the stop 50 is down, all of the workpieces on the conveyor 22 are prevented from moving. When it is desired to release a workpiece for entrance into the first cleaning mechanism 100, the clamp 30 engages the workpiece 12 immediately beneath the shoe 42, and the stop 50 is raised at the same time (FIG. 8). The just-released workpiece 12 passes over the limit switch 502 and is conveyed by the conveyor 62 to a position beneath the pusher 70. As can be seen from an examination of FIG. 15, when the stop 50 is raised, the clamp 30 is lowered and the arm 86 is raised. One-half second later, the pusher 70 is returned and, one-half second after the pusher 70 is completely returned, the arm 86 is lowered. One-half second later, the pusher 70 is moved on its forward stroke to advance the workpiece 12 toward the cleaning mechanism 100.

Although the various limit switches and their function have been described already, a particularly advantageous feature of the invention relates to the use of the limit switch 504 to control forward movement of the pusher 70. The pusher 70 is advanced on its forward stroke until a signal is received from the limit switch 504. Because the limit switch 504 is activated only by the trailing end of a workpiece 12, the pusher 70 cannot be returned until a workpiece 12 completely passes from the first cleaning mechanism 100. Accordingly, the length of the stroke of the pusher 70 automatically is controlled.

During a change-over period from one workpiece size to another, the foregoing control of the pusher 70 is modified somewhat. During change-over periods, the pusher 70 is moved forward slowly in small increments on the order of 250 mm. As the pusher 70 moves forward through each increment, the pusher 70 will be delayed for a few seconds to see if limit switch 504 has been tripped. If limit switch 504 has been tripped, the pusher 70 will be delayed until the wheel 202 indexes completely before returning. This technique of controlling the pusher 70 permits workpieces of different lengths to run together during a change-over period and prevents the release of two workpieces at one time.

From the foregoing description, it will be apparent that the invention provides an effective technique for automatically cleaning workpieces such as automobile engine blocks in a minimum period of time and with maximum efficiency. The various limit switches, stops, and brakes all function to prevent damage to the apparatus 10 while, at the same time, permitting substantially automatic functioning of the apparatus 10. Because the workpieces are inverted twice during their passage through the apparatus 10, accumulated cleaning media is discharged from passages in the workpieces and all surfaces of the workpieces are exposed to cleaning media.

Although the invention has been described in its preferred form with a certain degree of particularity, it will be understood that the present disclosure of the preferred embodiment has been made only by way of example and that numerous changes may be resorted to without departure from the true spirit and scope of the invention as hereinafter claimed. It is intended that the patent shall cover, by suitable expression in the appended claims, whatever features of patentable novelty exist in the invention disclosed.

What is claimed is:

1. Apparatus for cleaning a succession of workpieces having various outer configurations comprising:

a first cleaning mechanism for directing coincident streams of cleaning media against predetermined surfaces of a plurality of workpieces, said first cleaning mechanism including a chamber having open entrance and exit ends, a path of travel extending through the chamber from the entrance end to the exit end along which workpieces are advanced in end to end contact, and a plurality of blast wheels disposed adjacent the path of travel, the blast wheels directing cleaning media against the workpieces;

an advancing mechanism for moving the workpieces along the path of travel through the first cleaning mechanism, the advancing mechanism including a first conveyor, a clamp for engaging and controlling movement of the workpieces along the first conveyor, a stop for engaging the workpieces and preventing their movement along the first conveyor, workpieces being permitted to be advanced to the stop upon selective actuation of the clamp, a second conveyor for advancing workpieces from the first conveyor to the first cleaning mechanism, and a pusher for engaging the workpieces to force them into the first cleaning mechanism, workpieces being presented to the pusher sequentially upon selective actuation of the stop and the second conveyor;

a turning mechanism for inverting and spacing the workpieces after their exit from the first cleaning mechanism;

a control switch positioned at the discharge end of the first cleaning mechanism, the control switch serving to actuate the advancing mechanism only when a workpiece has exited from the first cleaning mechanism; and a second cleaning mechanism for directing cleaning media against surfaces of the workpieces not cleaned by the first cleaning mechanism, said second cleaning mechanism including a chamber having open entrance and exit ends, a path of travel extending through the chamber from the entrance end to the exit end along which workpiece are advanced, a plurality of blast wheels disposed adjacent the path of travel, the blast wheels directing cleaning media agaisnt the workpieces, and means for moving the workpieces along the path of travel, the means for moving the workpieces along the path of travel also maintaining the workpieces in a pre-determined spaced relationship as the workpieces advance along the path of travel.

2. The apparatus of claim 1, wherein the clamp firctionally engages the workpieces.

3. The apparatus of claim 1, wherein the stop is in the form of a plate engaging workpieces at the face of the workpieces positioned closest to the first cleaning mechanism.

4. The apparatus of claim 1, wherein the pusher is in the form of a pivotally mounted arm carried by an axially movable carrier, the arm engaging the faces of the workpieces positioned furthest from the first cleaning mechanism on a forward stroke of the carrier, the arm being pivoted out of the way of the workpieces on a return stroke of the carrier.

5. The apparatus of claim 4, wherein the arm is pivoted in a vertically oriented plane positioned at right angles to the path of travel of the workpieces.

6. The apparatus of claim 1, wherein the control switch is in the form of a limit switch so constructed and arranged relative to the first cleaning mechanism that workpieces exiting the cleaning mechanism pass over the limit switch during initial portions of discharge from the first cleaning mechanism and contact the limit switch only upon being completely discharged from the first cleaning mechanism.

7. Apparatus as defined in claim 1, wherein the turning mechanism includes a plurality of radially extending slots into which workpieces can be placed.

8. Apparatus as defined in claim 7, wherein the turning mechanism includes an ejector which engages the workpieces disposed within the slots and displaces the workpieces toward the second cleaning mechanism.

9. Apparatus as defined in claim 8, wherein the turning mechanism includes an opening disposed at the base of each of the slots and the ejector includes a hydraulic ram displaceable through the openings.

10. Apparatus as defined in claim 7, wherein the turning mechanism includes four radially extending slots, each being spaced 90° from adjacent slots.

11. Apparatus as defined in claim 7, wherein the turning mechanism is rotatable about an axis perpendicular to the path of travel of the workpieces through the first cleaning mechanism.

12. Apparatus as defined in claim 11, further including a plurality of rollers disposed along the walls of the slots, the rollers rotatable about axes perpendicular to the path of travel of the workpieces.

13. Apparatus as defined in claim 1, wherein the first cleaning mechanism includes skid rails for supporting workpieces for movement along the path of travel.

14. Apparatus as defined in claim 1, further including a second turning mechanism for inverting the workpieces after their exit from the second cleaning mechanism, the second turning mechanism being positioned along the path of travel of the workpieces and including a plurality of radially extending slots into which workpieces can be placed.

15. Apparatus as defined in claim 1, wherein the means for moving the workpieces along the path of travel of the second cleaning mechanism is in the form of powered rollers.

* * * * *